United States Patent [19]

Hakansson

[11] Patent Number: 4,504,358

[45] Date of Patent: Mar. 12, 1985

[54] APPARATUS FOR HANDLING WHITE WATER IN A TWIN-WIRE MACHINE

[75] Inventor: Carl J. N. Hakansson, Karlstad, Sweden

[73] Assignee: KMW Aktiebolag, Karlstad, Sweden

[21] Appl. No.: 532,229

[22] Filed: Sep. 14, 1983

Related U.S. Application Data

[63] Continuation of Ser. No. 269,532, Jun. 2, 1981, abandoned.

[30] Foreign Application Priority Data

Jun. 5, 1980 [SE] Sweden ..... 8004199

[51] Int. Cl.[3] ..... D21F 1/66

[52] U.S. Cl. ..... 162/264; 162/299; 162/301

[58] Field of Search ..... 162/190, 203, 301, 264, 162/299

[56] References Cited

U.S. PATENT DOCUMENTS

| | | | |
|---|---|---|---|
| 3,821,073 | 6/1974 | Eriksson | 162/190 |
| 3,846,232 | 11/1974 | Kankaanpaa | 162/301 |
| 3,846,233 | 11/1974 | Kankaanpaa | 162/301 |
| 3,884,756 | 5/1975 | Gustafson | 162/299 |
| 3,951,736 | 4/1976 | Kobayashi | 162/301 |
| 4,012,279 | 3/1977 | Selander et al. | 162/190 |
| 4,267,017 | 5/1981 | North | 162/264 |

FOREIGN PATENT DOCUMENTS

| | | | |
|---|---|---|---|
| 1021506 | 11/1977 | Canada . | |
| 53-19408 | 2/1978 | Japan | 162/301 |

*Primary Examiner*—Peter Chin

*Attorney, Agent, or Firm*—Bell, Seltzer, Park & Gibson

[57] ABSTRACT

In order to produce a reduction in the content of suspended matter in the surplus white water in a twin-wire machine with a curved forming zone, an outer saveall for collecting white water thrown outwardly from the curved forming zone is divided up into at least two separate saveall compartments arranged after each other in the direction of travel of the wires. The white water that is caught in the separate saveall compartments is removed as separate fractions for reuse.

7 Claims, 1 Drawing Figure

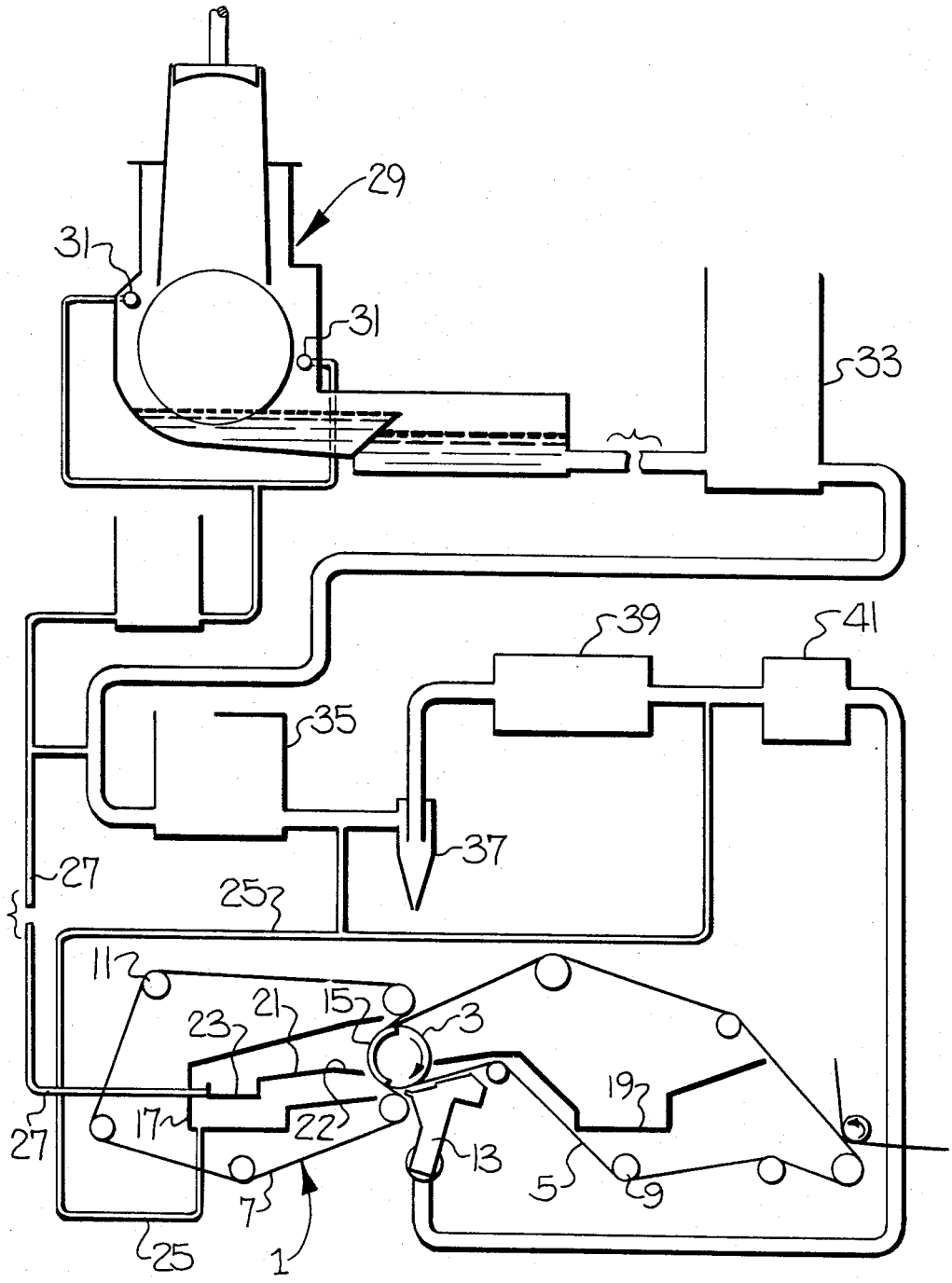
29
31
31
33
39
41
35
37
27
25
11
21
15
3
23
19
27
17
22
13
5
9
7
1
25

APPARATUS FOR HANDLING WHITE WATER IN A TWIN-WIRE MACHINE

CROSS-REFERENCE TO RELATED APPLICATIONS

This is a continuation of copending application Ser. No. 269,532, filed June 2, 1981 now abandoned.

BACKGROUND OF THE INVENTION

The present invention relates to an apparatus for handling white water in a twin-wire machine of the kind in which the wires define a curved forming zone from which white water containing suspended matter is thrown out, collected and substantially returned to the papermaking process.

The expression "forming zone" is used herein in the meaning generally accepted in the art, i.e., a zone extending from the point where dewatering of the stock through at least one wire begins up to the point where dewatering has progressed so far that the fibers forming the paper web can no longer float around in the suspension liquid, but bear against each other substantially immovably.

Water that is separated from a fiber suspension or fiber mat in a paper machine is called white water. White water usually contains fiber residues, sometimes also filler, dyes, rosin-size and the like, and is generally returned to the papermaking process. The flow circuit that is arranged for the return of white water to the process, and which comprises piping, storage containers, cleaning means and control equipment for the return flow, is called a white water system. A white water system is said to be open if a major part of the total white water flow leaves the system and is said to be closed if only a small part of the total white water flow leaves the system. A flow circuit for so-called short white water around a former is called a short circulation, and the term "short white water" refers to white water that is returned to the stage of the process from which it originated. Analogously, the term long circulation refers to a flow circuit for so called long white water, i.e., white water that is returned to a process stage other than the one from which it was separated.

The white water that is returned in a short circulation is used to dilute the stock from a higher consistency to headbox consistency, e.g., in newsprint making from above 2.5 percent by weight to below 1 percent by weight, and this return takes place without cleaning of the white water. At newsprint mills with Fourdrinier machines it is known that white water separated at the end of the Fourdrinier section has a considerably lower content of suspended matter than that of white water separated at the beginning of the Fourdrinier section. See, for example, Swedish Pat. Nos. 366,567 and 392,491. This cleaner white water is returned as a rule in a long circulation to the mill grinder room, but part of it can be conducted to a final cleaning before discharge into a suitable receiving body of water.

It is also known to divide up the white water from a Fourdrinier machine into three fractions with a purity increasing towards the end of the Fourdrinier section, with the cleanest fraction being conducted for final cleaning. The technical aspects of system design and closure of systems for newsprint machines of Fourdrinier type are given in a report "Skogsindustrins miljovardsprojekt" ("Forest Industry Environmental Project") from SSVL, *Stiftelsen Skogsindustriernas Vatten-och Luftvardsforskning* (The Water and Air Pollution Research Foundation of the Swedish Forest Industries), pages 151–155 and 178–190.

Further, a roll type twin-wire machine is described in U.S. Pat. No. 3,846,232 in which the forming zone curves along the shell face of a forming roll of suction roll type. The forming zone is followed by a slightly curved dewatering zone with a maximum length of about three times the diameter of the forming roll. In order to obtain the slight curve, the inner wire is supported along the dewatering zone by guiding means, such as rotatable rolls or one or more fixed and narrow foils or deflectors. It is stated that white water separated at the forming roll is collected in a first saveall and a second saveall and is conducted to the intake of the mixing pump supplying the headbox to be used as diluting water. It is also stated that white water which is separated from the formed paper web downstream of the forming zone and which usually has a lower content of fibers than white water from the forming roll, is collected in separate savealls to be conducted to a point in the water system where a lower fiber content is desired.

Due to the forced drainage of the stock at a forming roll as compared with a Fourdrinier section, the content of suspended matter will be higher at the forming roll, and compared with white water from the end of the Fourdrinier section, white water from the forming roll can have a content of suspended matter that is more than 50% higher. Thus, the surplus white water of high content, which remains after a first part has been recirculated as short white water for dilution of the stock to headbox consistency, cannot be used for other purposes requiring a lower content without further steps being taken.

SUMMARY OF THE INVENTION

The object of the present invention is to produce in a twin-wire former with a curved forming zone a reduction of the content of suspended matter in the surplus white water.

This is achieved according to the invention by a method and apparatus in which the discharges from a first portion and at least one succeeding portion of the curved forming zone are collected separately as separate fractions with a content of suspended matter decreasing in the machine direction, that at least a substantial part of the first fraction with a higher content is returned to the twin-wire machine as diluting water by a short circulation, and that at least one part of a succeeding fraction of lower content is removed from the actual papermaking process as surplus white water. By this means the content of suspended matter in the surplus white water can be reduced to the same level as for white water from the last part of a Fourdrinier section, so that cleaning of the surplus white water becomes unnecessary in cases where it can be recirculated to, for example, the mill grinder room, and/or so that the load on a final cleaning process is considerably reduced in cases where the surplus white water or part thereof shall be discharged into a receiving body of water after final cleaning.

BRIEF DESCRIPTION OF THE DRAWING

The invention will now be described in more detail with reference to the accompanying drawing, which in principle is a simplified flow chart of a paper mill including a grinder room, the mill being designed to permit the implementation of a preferred embodiment of the method and apparatus according to the invention.

DESCRIPTION OF ILLUSTRATED EMBODIMENT

The paper mill shown in a simplified form in the drawing includes a roll type twin-wire machine 1. The paper machine 1 consequently includes a rotatable forming roll 3, which is a suction roll in the embodiment shown, an inner wire 5 running in an endless loop around the forming roll 3 and supported by a portion of the forming roll, and an outer wire 7, which also runs in an endless loop and is supported via the inner wire 5 by said portion of the forming roll 3. The wires 5 and 7, which are kept tensioned by means of stretch rolls 9 and 11, run together on the forming roll 3 while forming a space, converging in the direction of rotation, for receiving a jet of stock from a headbox 13. The stock is dewatered by squeezing between the tensioned wires 5 and 7 as these wires follow the circumference of the rotating forming roll 3, whereby a web of paper is formed. The zone between the point where dewatering begins and the point where the fibers can no longer float around in the stock, but are substantially immovable in relation to each other, is called a forming zone. The forming zone 15 curves along the shell face of the forming roll 3. The suspension liquid that is expressed through the outer wire 7 owing to the squeezing of the stock between the wires 5 and 7 is removed by ejection due to the rotation of the roll 3 and is caught in a white water saveall 17 arranged inside the loop of the outer wire 7. The outer saveall 17 includes a pair of walls which define an enclosed area positioned for receiving and collecting the white water which is thrown outwardly from the curved forming zone 15. Each wall has a front portion located close to the forming zone 15 and a rear portion located away from the forming zone. In a similar way, suspension liquid or white water containing suspended matter is pressed through the inner wire 5 into the forming roll 3, where it is retained until the inner wire 5 runs off the forming roll 3, when it is ejected and caught by a white water saveall 19 located inside the inner wire loop. It is indicated in the drawing that white water collected in the outer saveall 17 is returned to the papermaking process, and correspondingly at least a substantial part of the white water collected in the inner saveall 19 is also returned, although this is not indicated in the drawing.

According to the invention, the discharges from a first and at least one succeeding part of the curved forming zone 15 are collected separately as separate fractions with a content of suspended matter decreasing in the machine direction. This is achieved in the embodiment shown in the drawing by inserting partition means in the form of a baffle 21 in the central part of the saveall 17 with respect to the circumferential direction of the roll, the baffle 21 extending between the end walls of the saveall 17 and having a front part 22 located close to the forming roll 3 and a rear part 23 formed in the shape of a channel or conduit for conducting away a leaner white water fraction. At least a substantial part of the first fraction with a higher suspended matter content is received in the area below the baffle 21 and is conducted through a pipe 25 to be returned to the twin-wire machine as diluting water by a short circulation, and at least a part of at least one succeeding fraction of a lower suspended matter content is received in the area above the baffle 21 and is removed from the papermaking process as surplus white water through a pipe 27 communicating with the rear part 23 of the baffle.

It is suitable that part of the said succeeding fraction with a lower suspended matter content is returned in a long circulation to a stage which precedes the actual papermaking process. In the preferred embodiment shown, the twin-wire machine 1 is preceded by a grinder room, which is shown schematically in the form of a grinder 29, and at least a part of the part of the fraction of white water returned in the long circulation is returned to the grinder room, where it is preferably used as shower water by being sprayed from a plurality of shower pipes 31, two of which are shown. The grinder 29 can be of conventional design or, if so desired, be constructed for grinding wood under steam or gas pressure higher than atmospheric pressure. The shower water cools the grinding zone to a suitable working temperature and dilutes the groundwood to a suitable consistency, e.g., about 0.9% for a first cleaning stage, which is not shown.

After several treatment stages, the groundwood comes to a mixing chest 33, where it is mixed in suitable proportions with disintegrated broke and sulphite pulp. The outgoing pulp can have a consistency of about 3% and is conducted, while being diluted with lean white water from the pipe 27 to e.g. 2.8%, to a machine chest with a level box. Machine chest and level box are shown on the drawing and indicated by a single symbol designated 35. Pulp passes from the level box, while being heavily diluted with short white water from the pipe 25 suitably down to a consistency of about 0.7%, through a vortex cleaner 37 to a deculator 39, from which the diluted pulp or stock, after further dilution with short white water from pipe 25 to a consistency of about 0.67%, is conducted through screens 41 to the headbox 13.

When the stock entering the headbox 13 had a consistency of 6.9 g/l, the illustrated division of the outer saveall 17 by baffle 21 gave a consistency of 2.4 g/l for the short white water being conducted through the pipe 25 and a consistency of 1.5 g/l for the long white water passing through the pipe 27. The white water ejected from the inside of the forming roll 3 into the inner saveall 19 had a consistency of 2.1 g/l.

The invention is not limited to the preferred embodiment illustrated and described herein as an example, but can be varied within the scope of the claims that follow. For example, more than one baffle can be arranged in the outer saveall for dividing up the white water discharge into more than two fractions with different contents of suspended matter. Although this is not shown, it should be clear that part of the white water after final cleaning can be conducted to a suitable receiving body of water, and the long white water does not need to be conducted to a grinder room. In case it is desired that the curved forming zone should have a bigger radius of curvature than that easily attained with a forming roll and/or should have a changing, e.g., decreasing radius of curvature in the direction of travel of the wires, this can be achieved in a way well known in the art by means of suitably located wire guiding elements, e.g., foils or deflectors.

In the drawings and specification, there has been set forth a preferred embodiment of the invention, and although specific terms are employed, they are used in a generic and descriptive sense only and not for purposes of limitation.

That which is claimed is:

1. A twin-wire papermaking machine comprising a forming roll, a pair of wires mounted for movement along a common curved path around said forming roll, said path defining a curved forming zone from which white water containing suspended matter is thrown radially outwardly during movement of the pair of wires along said curved path around the forming roll, and means for handling the white water removed from the forming zone, said means comprising a saveall located radially out-wardly of the curved forming zone on one side thereof and including a pair of walls defining an enclosure with an opening positioned facing said forming roll and said curved forming zone for receiving and collecting the white water which is thrown outwardly from the curved forming zone, each of said walls extending in a generally horizontal direction and having a front portion located toward said forming zone and a rear portion located away from the forming zone, at least one partition mounted in said saveall between said pair of walls and defining within said saveall a first saveall compartment positioned for receiving and collecting white water discharged from a first portion of the forming zone, and at least one additional saveall compartment positioned downstream in the machine direction from said first saveall compartment for receiving and collecting as a separate fraction white water discharged from another portion of the forming zone, said at least one partition having a front portion located toward said forming zone and between said front portions of said pair of walls, and a rear portion formed in the shape of a channel for conducting away the collected white water fraction, means associated with said first saveall compartment for removing the thus collected white water therefrom, and means associated with said at least one additional saveall compartment for separately removing the thus collected white water therefrom.

2. A twin-wire papermaking machine comprising a forming roll, a pair of wires mounted for movement along a common curved path around said forming roll, said path defining a curved forming zone from which white water containing suspended matter is thrown radially outwardly during movement of the pair of wires along said curved path around the forming roll, and means for handling the white water removed from the forming zone, said means comprising a saveall located radially outwardly of the curved forming zone on one side thereof and including a pair of walls defining an enclosure with an opening positioned facing said forming roll and said curved forming zone for receiving and collecting the white water which is thrown outwardly from the curved forming zone, each of said walls extending over the width of said pair of wires and in a generally horizontal direction and having a front portion located toward said forming zone and a rear portion located away from the forming zone, a partition mounted in said saveall between said pair of walls and defining within said saveall a first saveall compartment positioned opposite a first portion of the forming zone for receiving and collecting white water discharged from said first portion of the forming zone and a second saveall compartment positioned downstream in the machine direction from said first saveall compartment and opposite a succeeding portion of the forming zone for receiving and collecting as a separate fraction white water discharged from said succeeding portion of the forming zone, said partition having a front portion located toward the forming zone between said front portions of said pair of walls, and a rear portion formed in the shape of a channel for conducting away the collected white water.

3. A twin-wire papermaking machine comprising a forming roll, a pair of wires mounted for movement along a common curved path around said forming roll, said path defining a curved forming zone from which white water containing suspended matter is thrown radially outwardly during movement of the pair of wires along said curved path around the forming roll, and means for handling the white water removed from the forming zone, said means comprising a saveall located radially outwardly of the curved forming zone on one side thereof and positioned for receiving and collecting the white water which is thrown outwardly from the curved forming zone, said saveall comprising a pair of walls, one being positioned downstream in the machine direction from the other, and each extending over the width of said pair of wires and in a generally horizontally direction and having a front portion located toward the forming zone and a rear portion located away from the forming zone, said pair of walls defining an enclosure with an opening facing said forming roll and said curved forming zone, a partition mounted in said saveall between said pair of walls and defining within said saveall a first saveall compartment positioned for receiving and collecting white water discharged from a first portion of the forming zone, and a second saveall compartment positioned downstream in the machine direction from said first saveall compartment for receiving and collecting as a separate fraction white water discharged from another portion of the forming zone, said partition having a front portion located toward the forming zone and a rear portion formed in the shape of a channel for conducting away the collected white water, conduit means associated with said rear portion of said partition for removing the thus collected white water therefrom, and conduit means associated with said rear portion of one of said walls for separately removing the thus collected white water therefrom.

4. A twin-wire papermaking machine comprising a forming roll, a pair of wires mounted for movement along a common curved path around said forming roll, said path defining a curved forming zone from which white water containing suspended matter is thrown radially outwardly during movement of the pair of wires along said curved path around the forming roll, and means for handling the white water removed from the forming zone, said means comprising a saveall located radially outwardly of the curved forming zone on one side thereof and including a pair of walls defining an enclosure with an opening positioned facing said forming roll and said curved forming zone for receiving and collecting the white water which is thrown outwardly from the curved forming zone, each of said walls extending over the width of said pair of wires and in a generally horizontal direction and having a front portion located toward said forming zone and a rear portion located away from the forming zone, a partition mounted in said saveall between said pair of walls and defining within said saveall a first saveall compartment positioned opposite a first portion of the forming zone for receiving and collecting white water discharged from said first portion of the forming zone and having a relatively high content of suspended matter, and a second saveall compartment positioned downstream in the machine direction from said first saveall compartment and opposite a succeeding portion of the forming zone for receiving and collecting as a separate fraction white water discharged from said succeeding portion of the forming zone and having a relatively lower content of suspended matter, means associated with said first saveall compartment for returning at least a portion of the thus collected white water having a relatively higher content of suspended matter to the twin-wire papermaking machine as diluting water, and means associated with said second saveall compartment for removing at least part of said succeeding fraction with a lower suspended matter content from the papermaking machine as surplus white water.

5. Apparatus according to claim 4 further comprising means for returning part of said succeeding fraction with a lower suspended matter content in a long circulation to a stage that precedes the twin-wire machine.

6. Apparatus according to claim 5 wherein said twin-wire machine is preceded by a grinder room, and said means for returning part of said succeeding fraction comprises means for returning said part of said succeeding fraction to the grinder room.

7. Apparatus according to claim 5 wherein said means for returning said fraction to the grinder room includes means for spraying said fraction as shower water in the grinder room.

* * * * *